US006301449B1

(12) United States Patent
Miura

(10) Patent No.: US 6,301,449 B1
(45) Date of Patent: Oct. 9, 2001

(54) METHOD AND APPARATUS FOR OPERATING A WORK APPARATUS WITH A REPLACEMENT COMPONENT

(75) Inventor: Kuniyuki Miura, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/432,159

(22) Filed: Nov. 2, 1999

(30) Foreign Application Priority Data

Nov. 4, 1998 (JP) ..... 10-312963

(51) Int. Cl.[7] ..... G03G 15/00
(52) U.S. Cl. ..... 399/12; 399/24; 399/27
(58) Field of Search ..... 399/12, 13, 24, 399/27–30

(56) References Cited

U.S. PATENT DOCUMENTS 5,596,388 * 1/1997 Ohkubo et al. ..... 399/111
5,634,169 * 5/1997 Barry et al. ..... 399/12
5,930,553 * 7/1999 Hirst et al. ..... 399/12 X
5,999,759 * 12/1999 Palumbo et al. ..... 399/27

* cited by examiner

*Primary Examiner*—William J. Royer
(74) *Attorney, Agent, or Firm*—Morrison & Foerster LLP.

(57) ABSTRACT

This invention provides a system and method for operating a work apparatus that includes a mechanism for performing a predetermined operation, such as, image formation and uses a replacement component to replace an expended or defective component of the work apparatus. A database that includes information about a characteristic of the replacement component communicatively links with the work mechanism and a reader reads identification information affixed to the replacement component. A device in the work mechanism receives from the database the information about the characteristic of the replacement component, which information corresponds to the identification information read from the replacement component. Either the replacement component or the operation of the work mechanism is adjusted according to the information about the characteristic of the replacement component.

19 Claims, 1 Drawing Sheet

METHOD AND APPARATUS FOR OPERATING A WORK APPARATUS WITH A REPLACEMENT COMPONENT

FIELD OF THE INVENTION

The invention relates to a process and device for making use of a replacement component. The invention also includes an apparatus generally employing the replacement component. The invention is applicable, for example, where an image forming apparatus such as a copier or laser printer employs a cartridge type toner bottle as the replacement component for dispensing toner during an image forming operation using the toner.

BACKGROUND OF THE INVENTION

Image forming apparatus employing powder, ink or similar toners require maintenance to replenish the toner repeatedly. A cartridge-type toner container is used as the replacement component for simplifying this work. In addition, consumables containing the toner, such as a developer unit, a photoconductive drum and the like, are used by themselves or in combination. Such consumables employ an expendable toner cartridge or a cartridge which is to be refilled with the toner.

In the field of image formation using toner, with expanded use of and increased demand for printers, copiers, facsimiles, microfilm reader printers and the like, the public demands continued improvement in printing and image quality.

In this connection, the public has become aware that the quality of printing and image formation varies depending upon the quality of the replacement components when they are used. Accordingly, each component replacement involves adjustment to reduce or eliminate such variations in quality. This results from the variations in use characteristics of the replacement components. For instance, powder toner may have variable chargeability depending upon the production lot, resulting in variations in image density or fogged images. Similar problems of varied use characteristics arise in the use of other replacement components, with the result that predetermined operating conditions are not stably achieved on occasion. A user must depend upon a service engineer to perform adjustments beyond the capability of the user, resulting in increased work for the service engineers and increased cost for users. This is inconvenient for users because it takes a long time before the adjustment is done.

SUMMARY OF THE INVENTION

According to the process and device for use of a replacement component and the work apparatus employing the same of this invention, differences between replacement components and set standard specifications or operating parameters can be determined so that the operation for proper use of the replacement component may be readily performed based on the varying characteristics of the replacement components. Hence, regardless of the varied characteristics of the replacement component, a predetermined type of operation may be performed in a stable manner using the loaded replacement component.

In the process device using the replacement component, in particular, each of the steps for proper use of the loaded replacement component is automatically performed, thus dispensing with steps done manually as well as key operations for effecting such steps. This provides convenience to both the service provider and the user. Additionally, the process device will not fail to operate properly or incur maintenance or operational problems as a result of the use of the replacement component.

The work apparatus permits each of the aforesaid means to automatically perform each corresponding step of the process for proper use of the loaded replacement component, thus accomplishing the predetermined operations in a stable manner despite the varied characteristics of the replacement component.

It is therefore, a feature of the invention to provide a process and device for use of a replacement component to provide proper operation based on information about the loaded replacement component, and to provide an apparatus employing the replacement component.

These and other objects, advantages and features of the invention will become apparent from the following detailed description thereof taken in conjunction with the accompanying drawing which illustrates an embodiment of the invention. The features of the invention may be applied by themselves, or in combinations of two or more thereof, as long as they are included within the general scope of the invention as described.

DETAILED DESCRIPTION OF THE INVENTION

Figure 1:
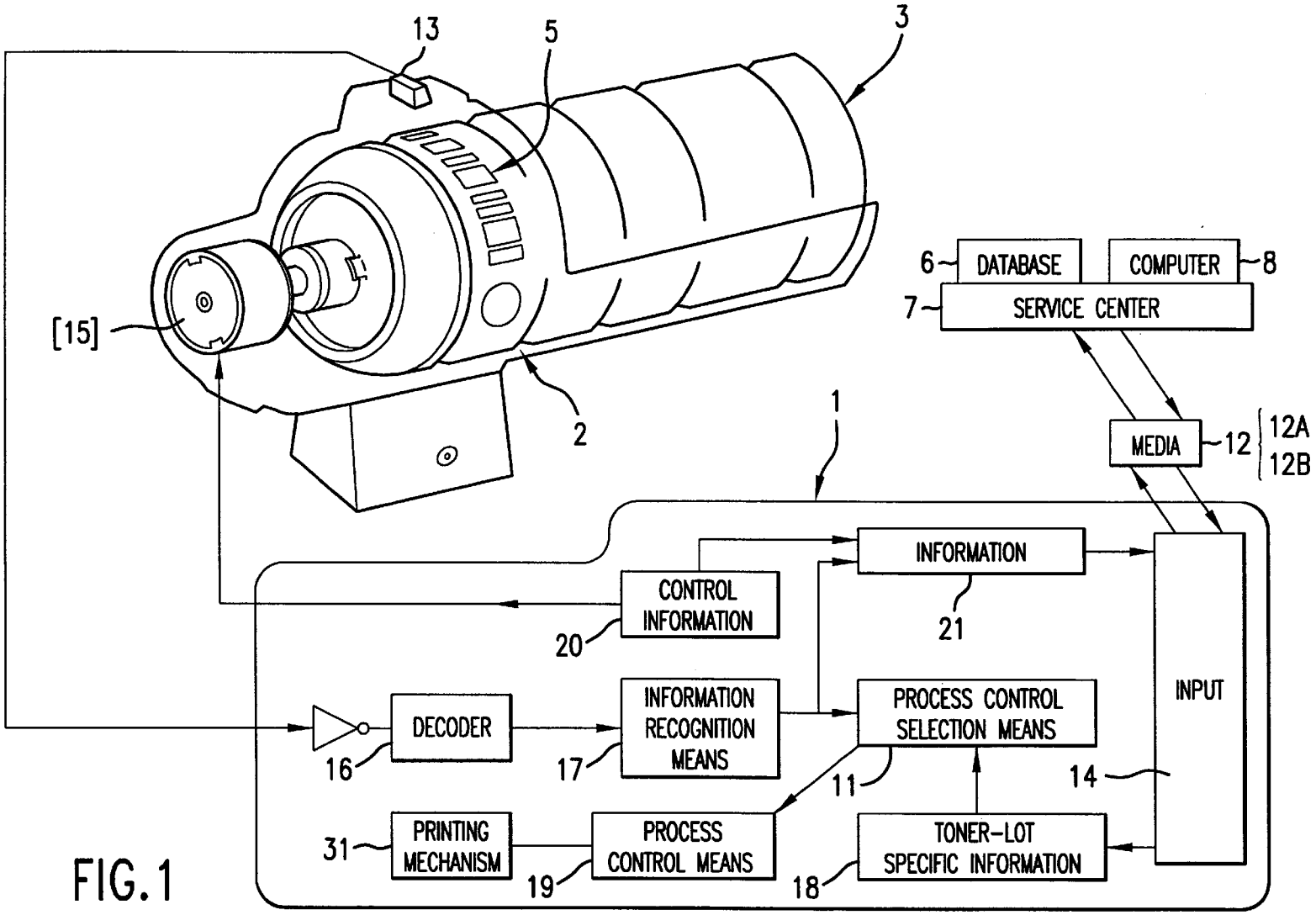
FIG. 1 is a schematic diagram showing a general system arrangement including a process and device for use of the replacement component with a printer in accordance with an embodiment of the invention.

For better understanding of the invention, reference is made to the following detailed description of the examples thereof to be read in conjunction with the drawing.

In one example of the invention, a toner bottle, for instance, is used as a replacement component for a printer which forms images with a powder toner. However, the invention is not limited to this example. For instance, a liquid toner, such as an ink, or other image forming material may be used. As a matter of course, the invention is similarly applicable to a case where other replacement components are used in other types of image forming apparatus other than the printer using the toner bottle, such as copiers, facsimiles, microfilm reader printers and the like. Further, the invention is also generally applicable to all sorts of apparatus that have necessary replacement components loaded therein for performing various operations. In the example shown in FIG. 1, a replaceable cartridge-type toner bottle 3 is loaded in a toner dispensing unit 2 of a printer body 1 performing image forming operations using the toner dispensed by the toner bottle 3. As shown in the following Table 1, for example, the toner may vary in chargeability from production lot to production lot, the chargeability representing a use characteristic.

TABLE 1

| ranking | Chargeability (uc/mg) |
|---|---|
| A | ~30 |
| B | 30~45 |
| C | 45~60 |
| D | 60~70 |
| E | 70~ |

In a case where, for example, a toner exhibiting a higher chargeability than specified is used under operating conditions wherein a toner of a specified chargeability is used for printing images of a predetermined quality, the resultant image may suffer lowered printing qualities such as reduced image density, fogging and the like.

As a solution to this problem, the differences among the production lots for the toner are represented by way of production lot numbers, production date and the like and such a representation is recorded as identification information 5 on the toner bottle 3 containing the toner in a way that it can be read out later. This record may be provided in the form of an optically readable bar-code, for example. However, the identification information 5 is not particularly limited in its format, recording system and reading system and could be in the form of magnetically readable symbols or codes, detectable protrusions and depressions and the like. As shown in Table 1, the use characteristics of the toner in toner bottle 3 loaded in the apparatus, such as toner chargeability, are ranked on a scale of A to E for use as ranking data. Then, as shown in Table 2 below, a database 6 may be prepared as a look-up table or the like to associate ranked use characteristics with the toners of respective production lot numbers represented by the identification information 5.

TABLE 2

| production lot | ranking data |
|---|---|
| 7900XXXX | C |
| 7O0XXXX | C |
| 7N0XXXX | C |
| 7D0XXXX | D |
| 810XXXX | C |

Such a database 6 may be generated by a service center 7 providing services which may include the maintenance of the printer and delivery of the toner bottle 3 as the replacement component when required. The service center 7 generates database 6 by editing information collected at the site and supplies users with information from the database as requested.

The database 6 is utilized through a connection to a computer 8 at the service center 7. Otherwise, the database is stored in electronic or other storage means, such as RAM, ROM, optical disk storage, magnetic tape or other conventional storage means and their equivalents. The information in the database is received or retrieved by the printer body 1 through various media 12 such as a communication link 12*a* which includes a communication line linked via a modem to a communication port or input 14 on printer body 1 and an information network like a LAN or WAN; and a recording medium 12*b* such as an IC memory card, floppy disk, optical disk or the like which the service provider supplies to the user of the printer or other apparatus for the purpose of offering the required component replacement services or other services usually provided to users of the apparatus. This service provider may be an automatic apparatus within the printer or included in associated equipment to replace components as they are due to be replaced. The service provider may also be a leasing company or equipment use contractor such as an in-house copying service in the case of printers, copiers and facsimile machines, which uses the information in the database to decide when and how maintenance may be performed. The information in the database is downloaded to the printer body 1 to be used. It is noted, however, that other systems may be employed for the reception or retrieval of the information.

The printer performs a component replacing process prior to image formation operations done by a printing mechanism 31 using the toner bottle 3 loaded therein. The component replacing process includes the steps of reading the identification information 5 on the toner bottle 3, and performing an adjustment operation to provide for proper use by the printer of toner in the toner bottle 3 based on toner-lot specific information 18 received or retrieved from the database 6 in correspondence with the identification information 5 read from the bottle by the printer.

That is, the characteristics of the toner in the toner bottle 3 that vary from toner lot to toner lot can be identified by reading the identification information 5 on the toner bottle 3 loaded in the printer body 1, so that information about characteristics specific to the toner or toner chargeability varying from toner lot to toner lot can be obtained by receiving or retrieving from the database 6 the toner-lot specific information 18 about the toner in the toner bottle 3 that corresponds with the information read by the printer body 1. Accordingly, despite the variations in the use characteristics or chargeability of the toner in the toner bottle 3 loaded in the printer body 1, proper operation of the printer is readily performed based on the information 18 thus received or retrieved in correspondence with the identification information 5 read by the printer body 1.

This process is performed in such a manner that operation of the printing mechanism 31 may be adjusted and changed based on a plurality of process control data items that are previously set in process control means 19 for operating the printing mechanism 31 relating to conditions that change according to predicted variations of the use characteristics or chargeability of the toner in the toner bottle 3 as the replacement component of the printer body 1. Based on these process control data items process control selection means 11 selects a suitable data item based on the received or retrieved toner-lot specific information 18. As shown in the following Table 3, the process control data items may defined as toner density correction data corresponding to the toner chargeabilities ranked on a scale of A to E such as to be used for the toner density correction operation.

TABLE 3

| ranking | Ratio of TC (%) |
|---|---|
| A | 3.70% |
| B | 3.60% |
| C | 3.50% |
| D | 3.20% |
| E | 3.10% |

In Table 3, the toner density is defined as the ratio of carrier(C) to toner(T). A process control data item for satisfying a required toner density is selected based on the ranked toner chargeability corresponding to the lot number determined for the toner bottle 3. This provides a stable formation of images with a predetermined quality regardless of the chargeability of toner in the toner bottle 3 varying from toner lot to toner lot. The possibilities for types of process data control items depend only on the nature of the working apparatus in which the replacement component is to be used and on the nature of the operating characteristics of the replacement component which may vary from lot to lot or over time. This invention can also be used to determine if replacement components are suitable for use, i.e., contain toner of the proper composition for the image forming apparatus, or have been kept in storage beyond their useful service lives or are otherwise unsuitable for use because they not the correct replacement parts. This invention is not limited to specific operating characteristics or types of process control data.

In the embodiment of FIG. 1, the toner bottle 3 in the toner dispensing unit 2 is rotated by a motor as required thereby feeding the toner therefrom to the printing mechanism 31. As the toner bottle 3 rotates, identification information 5 in the form of a bar-code affixed to the toner bottle 3 is optically read by an optical sensor 13 disposed within the toner dispensing unit 2. The optical signal thus read by the optical sensor 13 is converted by a decoder 16 into the identification information in a form capable to be recognized by information recognition means 17. For example, the printer body 1 can read the lot number or production date of the toner being used at the time of toner feeding. The information thus read is input to the process control selection means 11 together with the toner-lot specific information 18 and is used for the selection of the process control.

When required, the latest information on the machine control at the time of toner use is supplied from the service center 7 via any of the aforesaid various media 12 and downloaded to the printer body 1 receiving or retrieving the information. On the other hand, control information 20 on toner feeding from the toner bottle 3 and information 21 about toner consumption represented by a number of printed sheets are stored in the printer body 1 so as to be uploaded to the computer at the service center 7.

The service center 7 provides downloadable information on machine control such as correction data for accommodating the toner variations depending on toner lots. In addition, pieces of information about the toner bottle 3, the date and the like, which are read from the toner bottle 3 while the printer is in use and stored in the printer body 1, are uploaded to the computer 8 at the service center 7 via the communication link 12*a*. Otherwise, the serviceperson may acquire the information on the printing operations from the printer body 1 by way of the recording medium 12*b* by uploading to the computer 8 at the service center 7 the data regarding the operation conditions of the printer body 1 and consumption of the consumable. The computer 8 at the service center 7 collects all such pieces of information which are incorporated in the subsequent provision of services.

The service center 7 calculates operation conditions of the user's printer body 1, amount of toner consumption, toner consumption rate, and the lot number of the toner in use based on information items about the toner consumption, number of produced prints and operation time, which are obtained from the market. The service center can provide services by referring to such calculated information for more efficient service activities. An upper level organization may collect these information items for the purpose of incorporating them into the production control of replacement components and other consumables. This allows for production adjustment as required.

On the other hand, the information recorded on the toner bottle 3 may be utilized for identification of the printer body 1 in use. Accordingly, the identification information 5 on a reclaimed toner bottle 3 may be read to determine the type and production lot of the used toner. This information aids in recycling activities. Specifically, the identification information 5 on reclaimed toner bottles may be read and used for automatic separation thereof according to the materials of the bottles and types of toner remaining therein. Such a use of the information is effective in streamlining recycling activities.

It is also possible to obtain information about a period from the toner production to time of recycling the toner bottle, because the information indicative of the number of toner lot and production date can be read from the reclaimed toner bottle.

In an alternative example, encryption information besides these information items may be stored so that the printer body 1 stops printing operations when a toner bottle 3 loaded in the printer body 1 is determined to be a defective product because of a lack of match between information encrypted thereon with the stored encryption information. Thus, the use of so-called pirated toner can be prevented.

Although this invention has been described with reference to particular embodiments, it will be appreciated that many variations may be resorted to without departing from the spirit and scope of this invention. For example, the invention may be used on any apparatus or device that contains expendable, replaceable components that vary in characteristics, not simply on image forming apparatus. The various means and their corresponding structures disclosed herein are therefore not limited to image forming apparatus. It is also possible for the data bases and communications links used in the invention to be provided and accessed over computer networks, such as corporate Intranets and other internetworked systems, including but not limited to the Internet or the World Wide Web.

What is claimed is:

1. A process for performing an operation in a work apparatus containing a replacement component bearing identification information and loaded in the work apparatus, comprising:

removing an expended or defective component from the work apparatus and replacing said expended or defective component with the replacement component;

reading the identification information on the loaded replacement component;

accessing and reading from a database operational characteristics information of the replacement component in correspondence with the identification information of the replacement component;

adjusting characteristics of the replacement component or the work apparatus based on the operational characteristics information; and performing said operation of the replacement component or work apparatus.

2. The process in accordance with claim 1, further comprising adjusting the performance of the operation based on said operational characteristics information.

3. The process in accordance with claim 1, wherein said replacement component is a replaceable toner container for an image forming apparatus and said operational characteristics are one or more characteristics selected from the group consisting of toner chargeability, toner density, toner composition and storage time of the toner container.

4. The process in accordance with claim 1, wherein the database containing operational characteristics information is contained within the work apparatus.

5. The process in accordance with claim 1, further comprising linking the database containing operational characteristics information with the work apparatus by means of a local area network, a wide area network, the Internet, a modem-linked telephone line or a direct connection.

6. A device for use of a replacement component loaded in a work apparatus, comprising:

a database containing information about a characteristic of the replacement component linked by a communications link with the work apparatus;

a reader for reading identification information affixed to the replacement component loaded in the work apparatus;

receiving means for receiving from the database information about a characteristic of the replacement component in correspondence with identification information read from the replacement component; and processing means for adjusting the replacement component or the work apparatus and performing an operation of the replacement component loaded in the work apparatus based on an output of the receiving means of the information about the characteristic of the replacement component.

7. The device for use of a replacement component according to claim 6, wherein the information about the characteristic of the replacement component comprises information about use characteristics, structure, composition or operational properties of the replacement component.

8. The device for use of a replacement component according to claim 6, wherein the work apparatus is an image forming apparatus, the replacement component is a toner bottle containing toner used for image formation, the information about the characteristic of the replacement component is information on toner chargeability and the processing means corrects toner density in image formation based on the information on toner chargeability.

9. The device for use of a replacement component according to claim 6, wherein the communications link is selected from the group consisting of a local area network, a wide area network, the Internet, a modem-linked telephone line and a directly connected link between the database and the processing means.

10. The device for use of a replacement component according to claim 6, further comprising a service provider for installing replacement components as components within the work apparatus become expended or defective.

11. The device for use of a replacement component according to claim 6, wherein the database including information about the characteristic of the replacement component is included within the work apparatus.

12. A work apparatus comprising:

a work mechanism performing a predetermined operation using a replacement component loaded therein;

a database containing information about a characteristic of the replacement component communicatively linked with the work mechanism;

a reader for reading identification information affixed to the replacement component loaded in the work mechanism;

receiving means disposed in the work mechanism for receiving from the database the information about a characteristic of the replacement component in correspondence with said identification information read from the replacement component; and processing means for adjusting the replacement component or the work mechanism and performing the predetermined operation based on an output of the receiving means of the information about a characteristic of the replacement component.

13. The work apparatus as claimed in claim 12, wherein the information about a characteristic of the replacement component comprises information about use characteristics, structure, composition or operational properties of the replacement component.

14. The work apparatus as claimed in claim 12, wherein the replacement component is a toner bottle containing toner; the predetermined operation comprises image formation using the toner; the information about a characteristic of the replacement component is information on toner chargeability and the processing means corrects toner density in image formation based on the information on toner chargeability.

15. The work apparatus as claimed in claim 12, wherein the database containing information about a characteristic of the replacement component is contained within the work mechanism.

16. An image forming apparatus comprising:

a portion for receiving a replacement unit;

a reader for reading out identification information from said replacement unit;

a receiver for receiving characteristic information from a database;

a selector for selecting information from the characteristic information according to the identification information; and a controller for changing an image forming condition based on the selected information.

17. The image forming apparatus according to claim 16, wherein the characteristic information comprises information about use characteristics, structure, composition or operational properties of the replacement unit.

18. The image forming apparatus according to claim 16, wherein the replacement unit is a toner bottle containing toner used for image formation, the identification information includes information reflecting toner chargeability and the controller corrects toner density in image formation based on the information on toner chargeability.

19. The image forming apparatus according to claim 16, further comprising a service provider for installing replacement units as components within the portion for receiving replacement units as components of the image forming apparatus become expended or defective.

* * * * *